US011612929B2

(12) United States Patent
Arbesman

(10) Patent No.: US 11,612,929 B2
(45) Date of Patent: Mar. 28, 2023

(54) TEXTURE WORKPIECE AND METHOD FOR TEXTURING A WORKPIECE

(71) Applicant: GRIPMETAL LIMITED, Dublin (IE)

(72) Inventor: Ray Arbesman, Toronto (CA)

(73) Assignee: GRIPMETAL LIMITED, Dublin (IE)

( * ) Notice: Subject to any disclaimer, the term of this patent is extended or adjusted under 35 U.S.C. 154(b) by 0 days.

(21) Appl. No.: 16/482,152

(22) PCT Filed: Jan. 26, 2018

(86) PCT No.: PCT/IB2018/050496
§ 371 (c)(1),
(2) Date: Jul. 30, 2019

(87) PCT Pub. No.: WO2018/138683
PCT Pub. Date: Aug. 2, 2018

(65) Prior Publication Data

US 2019/0351476 A1 Nov. 21, 2019

Related U.S. Application Data

(60) Provisional application No. 62/452,063, filed on Jan. 30, 2017.

(51) Int. Cl.
*E04C 5/03* (2006.01)
*B21F 25/00* (2006.01)
(Continued)

(52) U.S. Cl.
CPC ..... *B21F 25/00* (2013.01); *B21F 45/006* (2013.01); *B21J 5/068* (2020.08); *B21J 5/12* (2013.01); *E04C 5/03* (2013.01)

(58) Field of Classification Search
CPC ... B21J 5/12; B21J 5/068; B21F 25/00; B21F 45/006; E04C 5/03
(Continued)

(56) References Cited

U.S. PATENT DOCUMENTS 870,129 A * 11/1907 Shaw ..... E04C 5/03 52/857
884,341 A * 4/1908 Ramsey ..... E04C 5/03 52/857
(Continued)

FOREIGN PATENT DOCUMENTS

CN 102864777 A * 1/2013
CN 203096740 U * 7/2013
(Continued)

OTHER PUBLICATIONS

International Search Report dated Apr. 11, 2018, PCT/IB2018/050496 filed Jan. 26, 2018, 5 pgs.

*Primary Examiner* — Brent W Herring
(74) *Attorney, Agent, or Firm* — Brooks Kushman P.C.

(57) ABSTRACT

A textured workpiece includes a body having an outer surface with at least a first surface portion. At least one of the body and the first surface portion is non-planar. A first set of barbs extends from and is integral with the first surface portion. A first set of grooves is formed in the first surface portion. Each barb of the first set barbs is associated with a respective one of the grooves of the first set of grooves. The workpiece can be used as reinforcing bar (rebar).

11 Claims, 6 Drawing Sheets

(51) Int. Cl.
*B21F 45/00* (2006.01)
*B21J 5/06* (2006.01)
*B21J 5/12* (2006.01)

(58) Field of Classification Search
USPC ..... 52/851, 831, 850, 852, 853, 855, 600, 52/649.1, 848, 431
See application file for complete search history.

(56) References Cited

U.S. PATENT DOCUMENTS 1,364,182 A * 1/1921 Conkling ..... E04C 5/03 52/850
1,416,117 A * 5/1922 Muir ..... E04C 5/03 52/850
1,423,163 A * 7/1922 Simpson ..... E04C 5/03 52/850
2,004,553 A * 6/1935 Een ..... E04C 2/14 52/514
2,256,401 A * 9/1941 Maze ..... F16B 15/02 411/454
2,260,779 A * 10/1941 Hoffmann ..... B21B 1/163 29/897.34
2,269,708 A * 1/1942 Dickson ..... F16B 15/06 411/453
2,709,819 A * 6/1955 Wise ..... A47C 27/066 5/260
2,759,389 A * 8/1956 Corckran ..... F16B 15/06 411/453
2,819,641 A * 1/1958 Corckran ..... F16B 15/06 411/456
2,870,626 A * 1/1959 Gillberg ..... B21B 1/163 52/856
2,927,497 A * 3/1960 Rapata ..... F16B 15/06 411/508
3,378,985 A * 4/1968 Bugan ..... E04C 5/03 52/852
3,473,433 A * 10/1969 Mayr ..... B25C 1/18 411/487
3,555,753 A * 1/1971 Magadini ..... E04C 2/06 52/223.7
3,693,496 A * 9/1972 Koide ..... F16B 15/0007 411/458
3,722,130 A * 3/1973 Handl ..... F16G 11/08 43/44.98
3,737,975 A * 6/1973 McKinnon, Jr. ..... B23K 20/085 403/44
3,866,286 A 2/1975 Pasternak
3,949,531 A * 4/1976 Fanson ..... B28B 7/18 52/380
4,619,096 A * 10/1986 Lancelot, III ..... E04C 5/165 52/848
4,718,210 A * 1/1988 McCourt ..... E04B 5/38 249/207
4,856,952 A * 8/1989 Shaw ..... E04C 5/125 411/413
5,376,410 A 12/1994 Mackelvie
8,615,856 B1 12/2013 Gelbart
9,243,406 B1 * 1/2016 Boguslavschi ..... E04C 5/03
9,463,502 B2 10/2016 Arbesman et al.
10,010,923 B1 * 7/2018 Arbesman ..... B32B 15/08
2004/0050004 A1 * 3/2004 McCann ..... E04B 1/41 52/404.2

FOREIGN PATENT DOCUMENTS

CN 208702007 U * 4/2019
EP 0832835 A2 4/1998
KR 20100055656 A * 5/2010

* cited by examiner

TEXTURE WORKPIECE AND METHOD FOR TEXTURING A WORKPIECE

CROSS-REFERENCE TO RELATED APPLICATION

This application is the U.S. national phase of PCT Application No. PCT/IB2018/050496 filed on Jan. 26, 2018, which claims the benefit of U.S. Provisional Application No. 62/452,063 filed on Jan. 30, 2017 the disclosures of which are incorporated in their entirety by reference herein.

FIELD

This document relates to textured workpieces, such as textured reinforcing bar (rebar), and methods for texturing workpieces. More specifically, this document relates to workpieces that are textured by a gouging process to create barbs that are integral with the workpiece.

BACKGROUND

U.S. Pat. No. 5,376,410 (MacKelvie) discloses a method for treating a surface which is to be bonded to another surface. The method comprises displacing a portion of the surface material to a position such that the displaced material, while remaining an integral part of the surface, forms a burr which is adapted to mechanically engage a flexible material placed adjacent thereto to thereby provide a mechanical interlocking action.

U.S. Pat. No. 9,463,502 (Arbesman) discloses a process for making bulk textured material sheeting. As a continuous supply of flat material sheeting is fed, the sheeting is repeatedly impacted with toothed knives, each knife creating a row of raised and generally pointed structures on the sheeting to texture the sheeting.

SUMMARY

The following summary is intended to introduce the reader to various aspects of the disclosure, but not to define or delimit any invention.

According to some aspects, a textured workpiece includes a solid body having an outer surface with at least a first surface portion. At least one of the body and the first surface portion is non-planar. A first set of barbs extends from and is integral with the first surface portion, and a first set of grooves is formed in the first surface portion. Each barb of the first set barbs is associated with a respective one of the grooves of the first set of grooves.

In some examples, the body is non-planar. The body can be an elongate metal bar. The body can be an elongate steel bar having a circular cross section.

In some examples, the first surface portion is non-planar. The first surface portion can be curved.

In some examples, the outer surface further includes a second surface portion. A second set of barbs can extend from and be integral with the second surface portion, and a second set of grooves can be formed in the second surface portion. Each barb of the second set barbs can be associated with a respective one of the grooves of the second set of grooves.

In some examples, the body extends along a longitudinal axis, and the first surface portion is spaced from the second surface portion in a direction transverse to the longitudinal axis.

In some examples, the body extends along a longitudinal axis, the first surface portion is at a first position along the longitudinal axis, and the second surface portion is at a second position along the longitudinal axis. The body can have a first-cross sectional profile at the first position, and a second cross-sectional profile at the second position. The first cross-sectional profile can be different from the second cross-sectional profile.

In some examples, the first surface portion and second surface portion are non-coplanar. The first surface portion and second surface portion can be non-parallel.

In some examples, the first surface portion has a first curvature, and the second surface portion has a second curvature, and the first curvature is different from the second curvature.

According to some aspects, a method for texturing a workpiece includes a) supplying a workpiece to a texturing apparatus. The workpiece includes a body having an outer surface with at least a first surface portion, and at least one of the body and the first surface portion is non-planar. The method further includes b) in the texturing apparatus, gouging the first surface portion to create barbs extending from and integral with the first surface portion.

In some examples, step b) includes cutting grooves into the first surface portion. Each of the barbs can be associated with a respective one of the grooves.

In some examples, the outer surface further includes a second surface portion. Step b) can include (i) gouging the first surface portion to create a first set of barbs extending from and integral with the first surface portion, and (ii) gouging the second surface portion to create a second set of barbs extending from and integral with the second surface portion.

In some examples, the first surface portion and the second surface portion are non-coplanar. The first surface portion and the second surface portion can be non-parallel.

In some examples, the first surface portion has a first curvature, and the second surface portion has a second curvature, and the first curvature is different from the second curvature.

In some examples, the texturing apparatus includes at least a first set of blades and a second set of blades. Step b) can include actuating the first set of blades to gouge the first surface portion, and actuating the second set of blades to gouge the second surface portion.

In some examples, step b) comprises simultaneously actuating the first set of blades and the second set of blades.

In some examples, step b) includes actuating the first set of blades along a first set of paths, and actuating the second set of blades along a second set of paths different from the first set of paths. The second set of paths can have a different orientation from the first set of paths.

In some examples, the first surface portion is non-planar. The first surface portion can be curved.

In some examples, the body is non-planar. The body can be an elongate metal bar. The body can be an elongate steel bar having a circular cross section.

According to some aspects, a reinforced material includes a matrix material, and a reinforcing bar embedded in the matrix material. The reinforcing bar has an outer surface with at least a first surface portion in contact with the matrix material. At least a first set of barbs extends from and is integral with the first surface portion, and is embedded in the matrix material. At least a first set of grooves is formed in first surface portion. Each barb of the first set of barbs is associated with a respective one of the grooves of the first set of grooves.

In some examples, the matrix material is concrete.

In some examples, the reinforcing bar includes a metal or an alloy. The reinforcing bar can include steel.

In some examples, the first surface portion is non-planar. The reinforcing bar can have a cross sectional profile that is curved.

In some examples, the outer surface further includes a second surface portion, a second set of barbs extending from and integral with the second surface portion, and a second set of grooves formed in the second surface portion. Each barb of the second set barbs is associated with a respective one of the grooves of the second set of grooves.

In some examples, the reinforcing bar extends along a longitudinal axis, and the first surface portion is spaced from the second surface portion in a direction transverse to the longitudinal axis.

In some examples, the body extends along a longitudinal axis, the first surface portion is at a first position along the longitudinal axis, and the second surface portion is at a second position along the longitudinal axis.

The reinforcing bar can be an elongate steel bar having a circular cross section.

According to some aspects, a textured workpiece includes a seamless body having an outer surface with at least a first surface portion. At least one of the body and the first surface portion is non-planar. A first set of barbs extends from and is integral with the first surface portion, and a first set of grooves is formed in the first surface portion. Each barb of the first set barbs is associated with a respective one of the grooves of the first set of grooves.

In some examples, the body is non-planar.

In some examples, the first surface portion is non-planar. The first surface portion can be curved.

In some examples, the body is hollow. In some examples, the body is tubular. The body can be an elongate metal tube. The body can be an elongate steel tube having a circular cross section.

In some examples, the outer surface further includes a second surface portion, a second set of barbs extending from and integral with the second surface portion, and a second set of grooves formed in the second surface portion. Each barb of the second set of barbs can be associated with a respective one of the grooves of the second set of grooves.

In some examples, the body extends along a longitudinal axis, and the first surface portion is spaced from the second surface portion in a direction transverse to the longitudinal axis.

In some examples, body extends along a longitudinal axis, the first surface portion is at a first position along the longitudinal axis, and the second surface portion is at a second position along the longitudinal axis. The body can have a first-cross sectional profile at the first position, and a second cross-sectional profile at the second position. The first cross-sectional profile can be different from the second cross-sectional profile.

In some examples, the first surface portion and second surface portion are non-coplanar. The first surface portion and second surface portion can be non-parallel.

In some examples, the first surface portion has a first curvature, and the second surface portion has a second curvature, and the second curvature is different from the first curvature.

According to some aspects, a textured workpiece includes a solid body having an outer surface with at least a first surface portion and a second surface portion. The first surface portion and second surface portion are non-parallel. A first set of barbs extends from and is integral with the first surface portion, and a first set of grooves is formed in the first surface portion. Each barb of the first set barbs is associated with a respective one of the grooves of the first set of grooves. A second set of barbs extends from and is integral with the second surface portion, and a second set of grooves is formed in the second surface portion. Each barb of the second set barbs is associated with a respective one of the grooves of the second set of grooves.

In some examples, the body is non-planar.

In some examples, the body extends along a longitudinal axis, and the first surface portion is spaced from the second surface portion in a direction transverse to the longitudinal axis.

In some examples, the body extends along a longitudinal axis, the first surface portion is at a first position along the longitudinal axis, and the second surface portion is at a second position along the longitudinal axis. The body can have a first-cross sectional profile at the first position, and a second cross-sectional profile at the second position. The first cross-sectional profile can be different from the second cross-sectional profile.

In some examples, at least one of the first surface portion and the second surface portion is non-planar. At least one of the first surface portion and the second surface portion can be curved. The first surface portion can have a first curvature, and the second surface portion can have a second curvature, and the second curvature can be different from the first curvature.

In some examples, the body is an elongate metal bar. The body can be an elongate steel bar having a circular cross section.

In some examples, the body is an elongate metal tube. The body can be an elongate steel tube having a circular cross section.

According to some aspects, a textured workpiece includes a seamless body having an outer surface with at least a first surface portion and a second surface portion. The first surface portion and second surface portion are non-parallel. A first set of barbs extends from and is integral with the first surface portion, and a first set of grooves is formed in the first surface portion. Each barb of the first set barbs is associated with a respective one of the grooves of the first set of grooves. A second set of barbs extends from and is integral with the second surface portion, and a second set of grooves is formed in the second surface portion. Each barb of the second set barbs is associated with a respective one of the grooves of the second set of grooves.

In some examples, the body extends along a longitudinal axis, and the first surface portion is spaced from the second surface portion in a direction transverse to the longitudinal axis.

In some examples, the body extends along a longitudinal axis, the first surface portion is at a first position along the longitudinal axis, and the second surface portion is at a second position along the longitudinal axis. The body can have a first-cross sectional profile at the first position, and a second cross-sectional profile at the second position. The first cross-sectional profile can be different from the second cross-sectional profile.

In some examples, at least one of the first surface portion and the second surface portion is non-planar. At least one of the first surface portion and the second surface portion can be curved. The first surface portion can have a first curvature, and second surface portion can have a second curvature, and the second curvature can be different from the first curvature.

In some examples, the body is an elongate metal bar. The body can be an elongate steel bar having a circular cross section.

In some examples, the body is an elongate metal tube. The body can be an elongate steel tube having a circular cross section.

In some examples, the body is non-planar.

According to some aspects, a method for texturing a workpiece includes a) supplying a workpiece to a texturing apparatus. The workpiece includes a body having an outer surface with at least a first surface portion and a second surface portion. The first surface portion and second surface portion are non-parallel. The method further includes b) gouging the first surface portion to create a first set of barbs extending from and integral with the first surface portion surface, and c) gouging the second surface portion to create a second set of barbs extending from and integral with the second surface portion.

In some examples, step b) includes cutting a first set of grooves into the first surface portion. Each of the barbs of the first set of barbs can be associated with a respective one of the grooves of the first set of grooves.

In some examples, step b) includes cutting a second set of grooves into the second surface portion. Each of the barbs of the second set of barbs can be associated with a respective one of the grooves of the second set of grooves.

In some examples, the body is non-planar. In some examples, the body is seamless.

In some examples, at least one of the first surface portion and the second surface portion is non-planar. The first surface portion can have a first curvature, and the second surface portion can have a second curvature, and the first curvature can be different from the second curvature.

In some examples, the texturing apparatus includes at least a first set of blades and a second set of blades. Step b) can include actuating the first set of blades to gouge the first surface portion, and step c) can include actuating the second set of blades to gouge the second surface portion.

In some examples, step b) and step c) are carried out simultaneously.

In some examples, step b) includes actuating the first set of blades along a first set of paths, and step c) includes actuating the second set of blades along a second set of paths different from the first set of paths. The second set of paths can have a different orientation from the first set of paths.

BRIEF DESCRIPTION OF THE DRAWINGS

The drawings included herewith are for illustrating various examples of articles, methods, and apparatuses of the present specification and are not intended to limit the scope of what is taught in any way. In the drawings.

DETAILED DESCRIPTION

Figure 1:
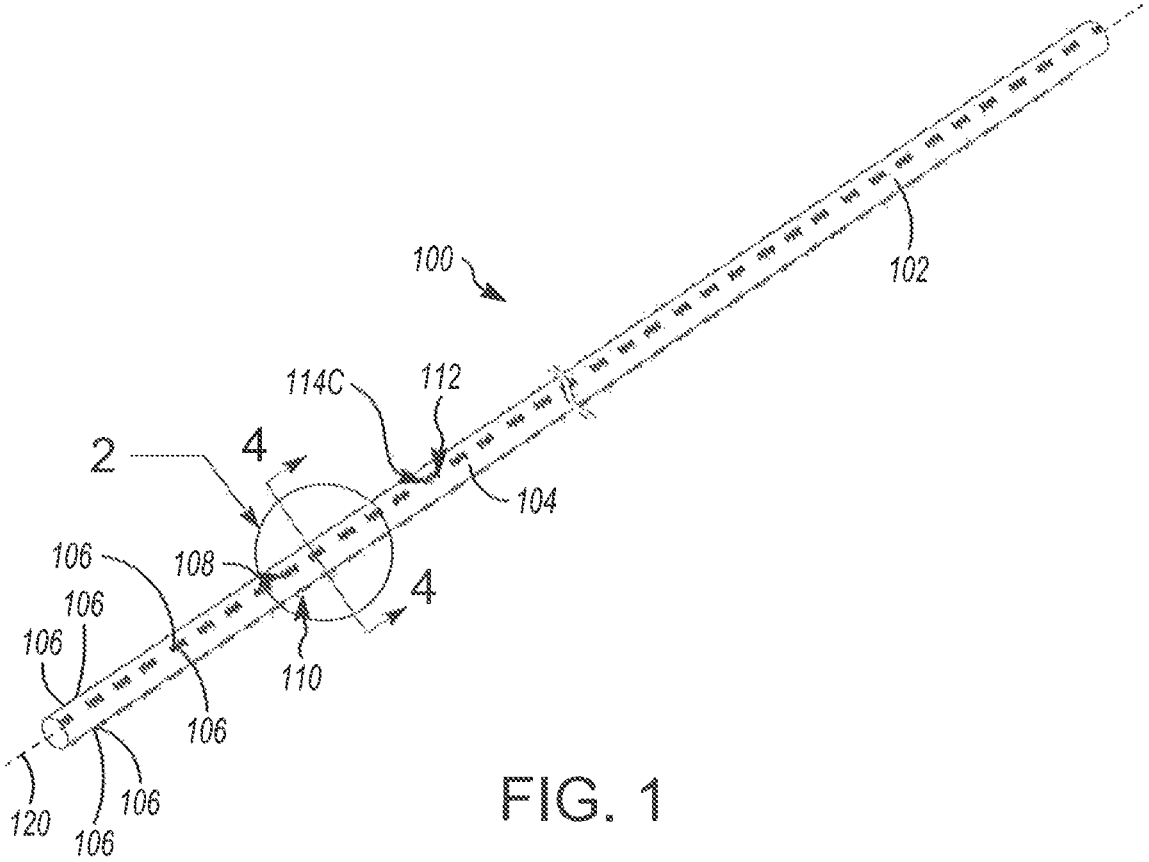
FIG. 1 is a perspective view of an example textured workpiece.

Various apparatuses or processes will be described below to provide an example of an embodiment of the claimed subject matter. No embodiment described below limits any claim and any claim may cover processes or apparatuses that differ from those described below. The claims are not limited to apparatuses or processes having all of the features of any one apparatus or process described below or to features common to multiple or all of the apparatuses described below. It is possible that an apparatus or process described below is not an embodiment of any exclusive right granted by issuance of this patent application. Any subject matter described below and for which an exclusive right is not granted by issuance of this patent application may be the subject matter of another protective instrument, for example, a continuing patent application, and the applicants, inventors or owners do not intend to abandon, disclaim or dedicate to the public any such subject matter by its disclosure in this document.

Disclosed herein are textured workpieces, and methods for texturing workpieces. In some examples, the workpieces are generally not planar. That is, in such examples, the workpieces are not flat sheets (e.g. sheet metal), or flat plates (e.g. brake backing plates). Instead, the workpieces may be non-planar objects, such as bars or tubes. The workpieces may in some examples be solid (e.g. in the case of a bar), or in some examples be hollow or partially hollow (e.g. in the case or a tube). The workpieces have an outer surface, and at least a portion of the outer surface may be textured with barbs that are integral with the surface.

In other examples, the workpieces may be of any suitable shape (i.e. planar or non-planar), but have an outer surface with at least a portion that is non-planar. The non-planar surface portion may be textured (either partially or fully) with barbs that are integral with the outer surface.

In further examples, the workpieces may be of any suitable shape (i.e. planar or non-planar), but have an outer surface with portions that are non-parallel. The non-parallel surface portions may be textured (either partially or fully) with barbs that are integral with the outer surface.

The barbs may be created in a process whereby the outer surface is gouged to cut grooves into the outer surface, creating a barb associated with each groove.

The textured workpieces described herein may have a variety of uses, and may provide a variety of advantages. For example, the portion of the outer surface that is textured may be joined to other materials, by embedding the barbs in the other materials. The barbs may provide a strong attachment to these additional materials. For example, the workpiece can be used as reinforcing bar (i.e. rebar). Rebar having an outer surface textured with barbs as described herein may form a strong attachment to a matrix material (e.g. concrete) in which it is embedded. This strong attachment may reduce or minimize the risk of pull-out of the rebar. Alternatively, the workpiece can be embedded in or joined to other materials, including but not limited to plastics, wood, foam, rubber, metals, polymers, and combinations thereof. Embedding or joining can be achieved, for example, by pressing or rolling the workpiece and the other material, to impale the other material on the barbs. Alternatively, embedding or joining can be achieved by forming the other material around the workpiece. For example, the workpiece can be placed in a mold, and the other material can be formed in the mold around the workpiece.

Referring now to FIG. 1, an example textured workpiece 100 is shown. In the example shown, the textured workpiece (also referred to herein simply as a "workpiece") includes a solid body 102. As used herein, the term "solid" is used to mean "not hollow". As used herein, the term "solid" excludes objects such as tubes or pipes.

Figure 2:
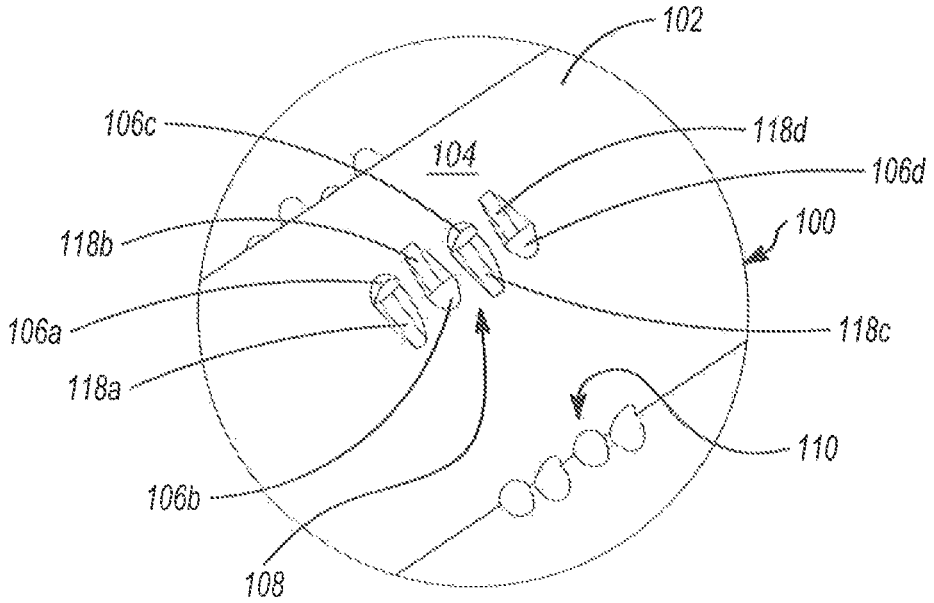
FIG. 2 is an enlarged view of the circled portion the textured workpiece of FIG. 1.
Figure 3:
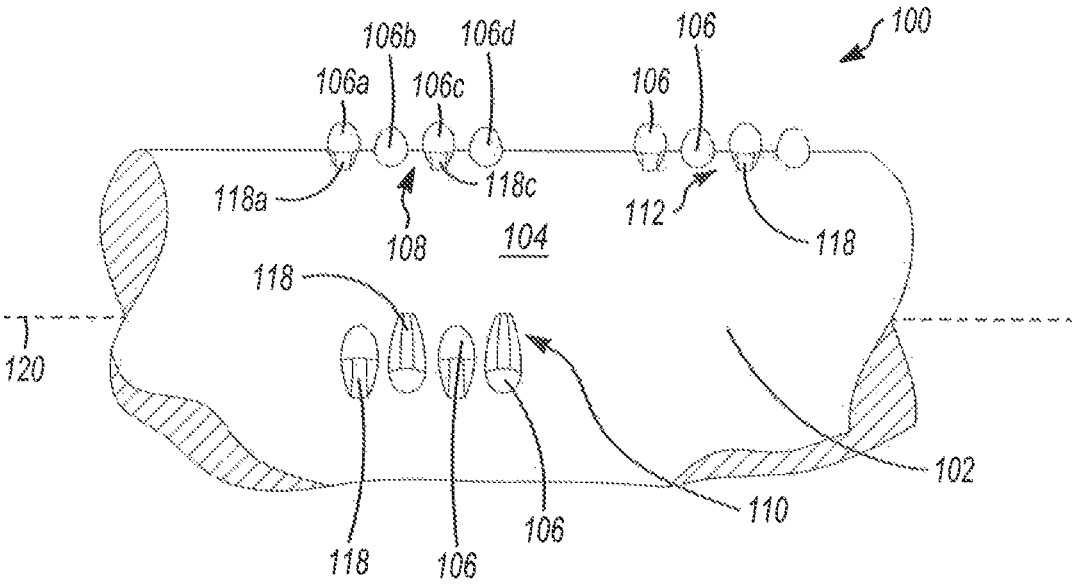
FIG. 3 is a side view of a portion of the textured workpiece of FIG. 1.

Referring also to FIGS. 2 and 3, the body 102 has an outer surface 104. At least a portion of the outer surface is textured with barbs 106 that extend from and are integral with the outer surface 104. More specifically, in the example shown, the outer surface 104 includes various portions (referred to herein as a first surface portion 108, a second surface portion 110, a third surface portion 112, and so on) that are textured with barbs 106. The barbs extend from and are integral with each respective portion. The barbs will be described in further detail below.

In the example shown, the various surface portions are spaced apart, along the length of the body 102 and/or around the circumference of the body 102. In alternative examples, different surface portions may be distinguishable in another manner. For example, the barbs of one surface portion may point in one direction, and the barbs of another surface portion may point in another direction. For further example, a first surface portion and a second surface portion may be adjacent each other, but may be non-coplanar, or non-parallel. Furthermore, in some examples, a body may include only one portion (i.e. only a first surface portion) that is textured with barbs. In such examples, the first surface portion may make up only a small fraction of the area of the outer surface, or the entire outer surface.

Figures 4, 5:
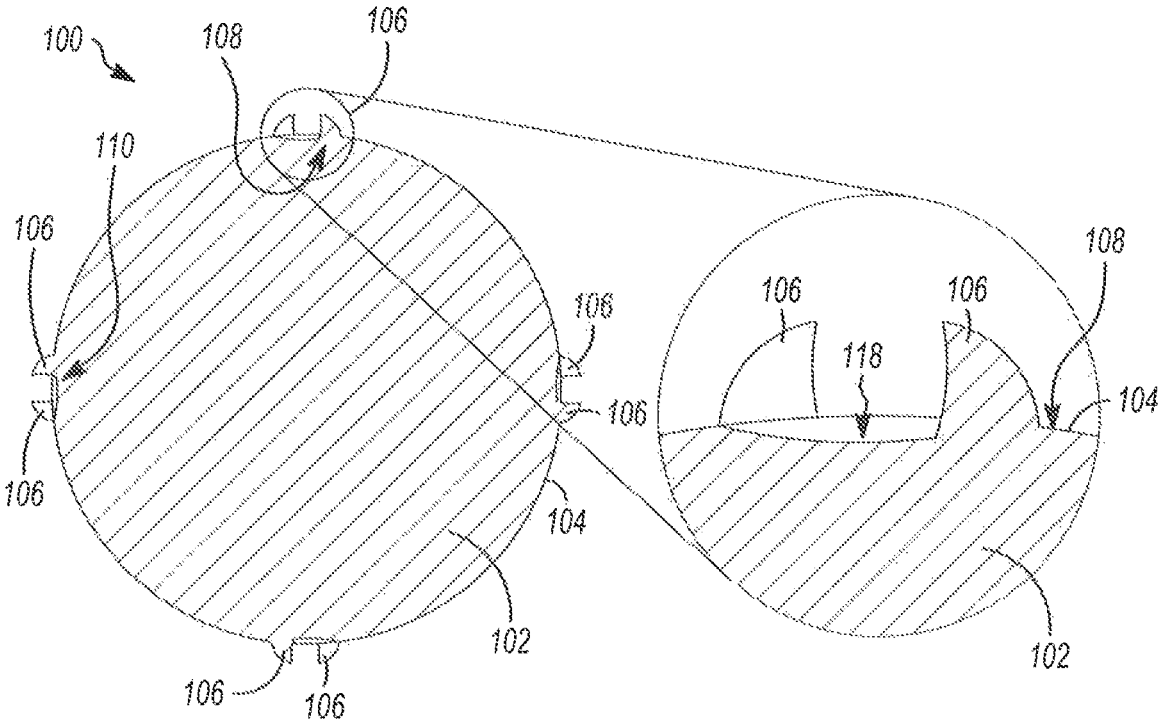
FIG. 4 is a cross-section taken along line 4-4 in FIG. 1.
FIG. 5 is an enlarged view of the circled portion of FIG. 4.

As used herein, the term "non-planar" can refer to objects (also called bodies) or surfaces. When used with respect to an object or body, the term "non-planar" indicates that the object or body is generally not flat. When used with respect to an object or body, the term "non-planar" excludes flat objects or bodies such as flat plates (e.g. brake backing plates) and flat sheets (e.g. sheet metal). When used with respect to a surface, the term "non-planar" indicates that the surface is not flat, regardless of the shape of the body or object that the surface is on. Referring to FIGS. 1 and 4, in the example shown, the body 102 is non-planar. In the example shown, the body 102 is a bar (also referred to as a rod) that is generally elongate and has a generally circular cross-section. Other examples of non-planar solid bodies include bars or rods having other cross-sectional shapes (e.g. oval or polygonal cross sectional shapes), solid cubes, solid spheres, and non-planar solid panels.

In alternative examples (described below with respect to FIG. 13), the body may be of another shape (i.e. can be planar or non-planar), but may have at least a first surface portion that is non-planar.

Referring to FIGS. 2 and 5, the barbs 106 are shown in greater detail. In the example shown, a first set of barbs 106 extends from and is integral with the first surface portion 108. A first set of grooves 118 is also formed in the first surface portion 108. Each barb 106 is associated with a respective one of the grooves 118. That is, the first set of barbs 106 includes a first barb 106*a*, a second barb 106*b*, a third barb 106*c*, and a fourth barb 106*d*. The first barb 106*a* is associated with a first groove 118*a*, the second barb 106*b* is associated with a second groove 118*b*, the third barb 106*c* is associated with a third groove 118*c*, and the fourth barb 106*d* is associated with a fourth groove 118*d*. The barbs 106 and grooves 118 may be created in the outer surface 104 by a gouging process (described in further detail below), wherein the outer surface 104 is cut to create a groove, and the removed material forms a barb 106, which remains attached to the outer surface 104. Accordingly, the phrase "associated with" indicates that a given barb is formed from the material removed when creating a given groove.

Figure 6:
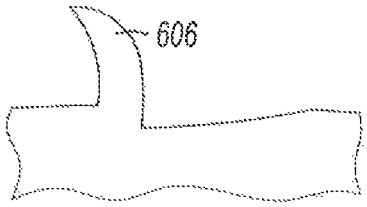
FIG. 6 is a schematic cross-section showing a barb of a first alternative shape.
Figure 7:
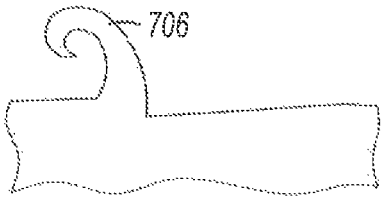
FIG. 7 is a schematic cross-section showing a barb of a second alternative shape.
Figure 8:
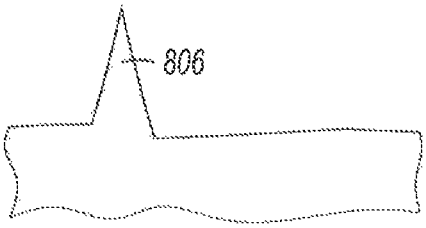
FIG. 8 is a schematic cross-section showing a barb of a third alternative shape.

In any of the examples described herein, the barbs may be of various shapes and sizes, such as bent, curled over, or straight. For example, referring to FIG. 6, a barb 606 that is bent (also called "hook-shaped" or "hooked") is shown. For further example, referring to FIG. 7, a barb 706 that is curled over is shown. For further example, referring to FIG. 8, a barb 806 that is generally straight is shown.

Referring back to FIGS. 1 and 3, as mentioned above, in the example shown, the body 102 includes several surface portions (e.g. surface portions 108, 110, 112) that are each textured with a respective set of barbs 106 and an associated set of grooves 118. More specifically, in the example shown, the body 102 includes several surface portions that are textured with four barbs 106 and four associated grooves 118. These surface portions are spaced apart along the length of the body 102 (i.e. are spaced apart in a direction parallel to a longitudinal axis 120 of the body), and also around the circumference of the body 102 (i.e. are spaced apart in a direction transverse to the longitudinal axis 120).

As mentioned above, the barbs 106 on the first surface portion 108 may be referred to as a first set of barbs 106, and the grooves 118 may be referred to as a first set of grooves 118. Similarly, the barbs 106 and grooves 118 on the second surface portion may be referred to as a second set of barbs 106 and a second set of grooves 118, and the barbs 106 and grooves 118 on the third surface portion 112 may be referred to as a third set of barbs 106 and a third set of grooves 118, respectively, and so on.

Referring to FIGS. 4 and 5, in the example shown, as mentioned above, the body 102 is circular in cross section. Accordingly, the surface portions that are textured with the barbs 106 and grooves 118 are non-planar. Instead, in the example shown, the surface portions that are textured with barbs 106 and grooves 118 are curved (or rounded). In other examples, even though the body may be non-planar, the surface portion that is textured may be planar.

Referring still to FIGS. 4 and 5, as the surface portions that are textured with barbs 106 and grooves 118 are non-planar, they cannot be considered to be parallel with each other or coplanar with each other. In other examples, where planar surface portions are textured, the planar textured surface portions may be either parallel or non-parallel, or coplanar or non-coplanar.

Referring still to FIGS. 4 and 5, in the example shown, the surface portions that are textured with barbs 106 and grooves 118 have the same curvature. In other examples, surface portions that are textured with barbs and grooves can have different curvature from each other.

Referring to FIG. 3, as mentioned above, in the example shown the first surface portion 108 and the third surface portion 112 are spaced apart in a direction parallel to the longitudinal axis 120 of the body 102. That is, the first surface portion 108 is at a first position along the longitudinal axis 120, and the second surface portion 110 is at a second position along the longitudinal axis 120. In the example shown, the body 102 has a first-cross sectional profile at the first position (shown in FIG. 4), and a second cross-sectional profile at the second position (not shown), and the first cross-sectional profile is the same (in size and shape) is the second cross-sectional profile. In alternative examples, the first cross-sectional profile may differ from the second cross-sectional profile (in size and/or shape), as will be described below with respect to FIG. 11.

The body 102 can be of a variety of sizes. In some examples, the body 102 having radius of as small as ¼ inch can be textured with barbs and grooves by gouging.

Figure 9:
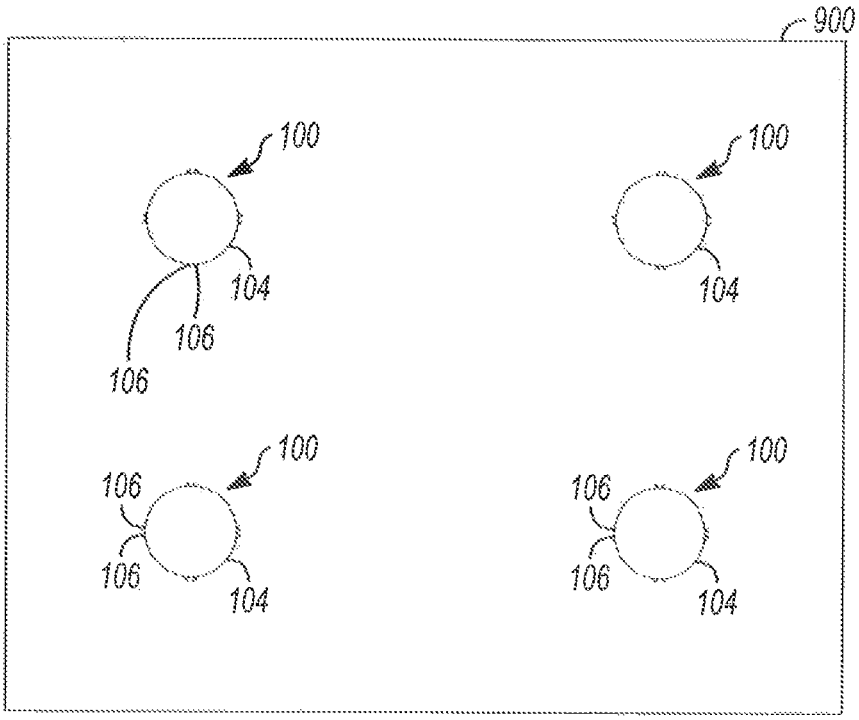
FIG. 9 is a cross-section through an example reinforced material including the textured workpiece of FIG. 1.

In the example shown, the workpiece 100 may be used as rebar. That is, referring to FIG. 9, the workpiece 100 may be embedded in a matrix material 900 such as concrete or another structural material, to reinforce the matrix material 900. When embedded in the matrix material 900, the outer surface 104 of the workpiece 100 is in contact with the matrix material 900, and the barbs 106 are in contact with and embedded in matrix material 900. The barbs 106 may facilitate strong attachment of the workpiece to the matrix material, and prevent or reduce the risk of pullout of the workpiece 100 from the matrix material 900.

In some examples, the outer surface 104 of the workpiece 100, including the grooves 118 and barbs 106, may be coated with a coating (e.g. epoxy) or galvanized prior to being used as rebar.

Figure 10:
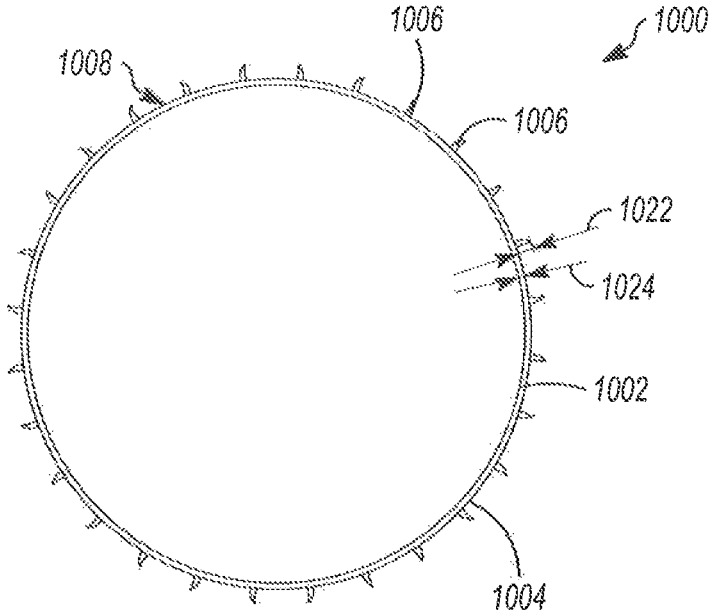
FIG. 10 is an end view of another example textured workpiece.

Referring now to FIG. 10, an alternative workpiece is shown. In this example, the workpiece 1000 includes a body 1002 that is hollow, and is in the form of a tube. The body 1002 is also seamless. That is, the body 1002 was formed by using a pre-formed tube as a starting material, and texturing the tube with barbs 1006 (e.g. by supplying a tube to the texturing apparatus as described below with respect to FIGS. 14 and 15). This is in contrast to using a sheet that is textured with barbs as a starting material, and rolling or winding the sheet into a tube. In such cases—where a barb-textured sheet is wound or rolled into a tube—the resulting tube will have a seam.

Similarly to the workpiece of FIGS. 1 to 5, the body 1002 of the workpiece 1000 has an outer surface 1004 having at least a portion that is textured with barbs. Specifically, the outer surface 1004 has a first surface portion 1008. A first set of barbs 1006 extends from and is integral with the first surface portion 1008, and a first set of grooves (not shown) is formed in the first surface portion 1008. Each barb 1006 is associated with a respective one of the grooves.

In the example shown, both the body 1002 and the first surface portion 1008 are non-planar. In alternative examples, the body may be planar and the first surface portion may be non-planar, and vice versa.

In the example shown, the first surface portion 1008 makes up the entire outer surface 1004, and the barbs 1006 are formed continuously in the first surface portion 1008 (i.e. the outer surface 1004 does not include discrete sets of barbs). In alternative examples, the first surface portion may make up less than the entire outer surface, and/or the outer surface may include more than one surface portion that is textured with barbs.

In the example shown, the height 1022 of the barbs 1006 is slightly less than the wall thickness 1024 of the body 1002. In other examples, the height 1022 of the barbs may be greater than the wall thickness 1024 of the body. Furthermore, the grooves (not shown) may have a length, and the length of the grooves may be greater than or less than the wall thickness 1024 of the body 1002.

The body 1002 can be of a variety of sizes. In some examples, a body 102 having a wall thickness of as small as 25 thou (thousandth of an inch) can be textured with barbs and grooves by gouging.

Textured workpieces in the form of a tube may have a variety of uses, for example as pipes or conduits. Other materials, such as coatings, sheaths, or wraps, may be joined to the outer surface of the tube, by embedding the barbs in the other material.

Figure 11:
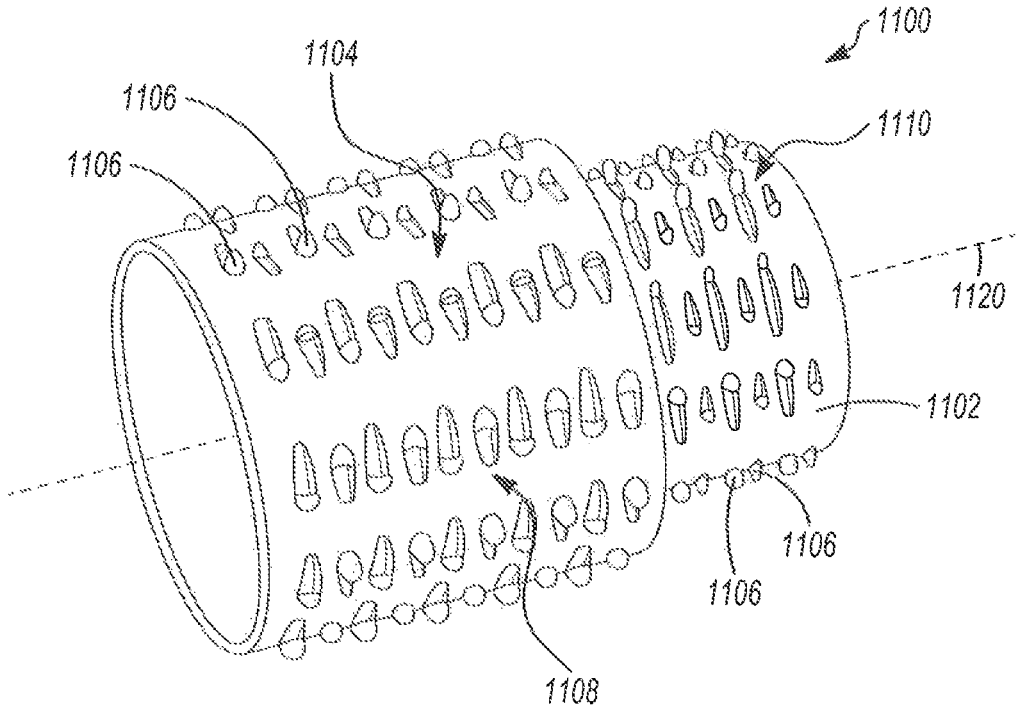
FIG. 11 is a perspective view of yet another example textured workpiece.

Referring now to FIG. 11, another workpiece 1100 is shown. Similarly to the workpiece 1000 of FIG. 10, the workpiece 1100 includes a body 1102 that is non-planar, hollow, and seamless. Furthermore, the body 1102 has an outer surface 1104 with a first surface portion 1108 and a second surface portion 1110, both of which are non-planar. A first set of barbs 1106 extends from and is integral with the first surface portion 1108, and a second set of barbs 1106 extends from and is integral with the second surface portion 1110.

In the example of FIG. 11, the body 1102 has a non-constant cross-sectional profile. That is, the first surface portion 1108 is at a first position along the longitudinal axis 1120, and the second surface portion 1110 is at a second position along the longitudinal axis 1120. The body 1102 has a first-cross sectional profile at the first position, and a second cross-sectional profile at the second position. The first cross-sectional profile has the same shape as the second cross sectional profile (i.e. the first and second cross-sectional profiles are annular), but differs from the second cross-sectional profile in size (i.e. the radius of the body 1102 at the first position is larger than the radius of the body 1102 at the second position).

Figure 12:
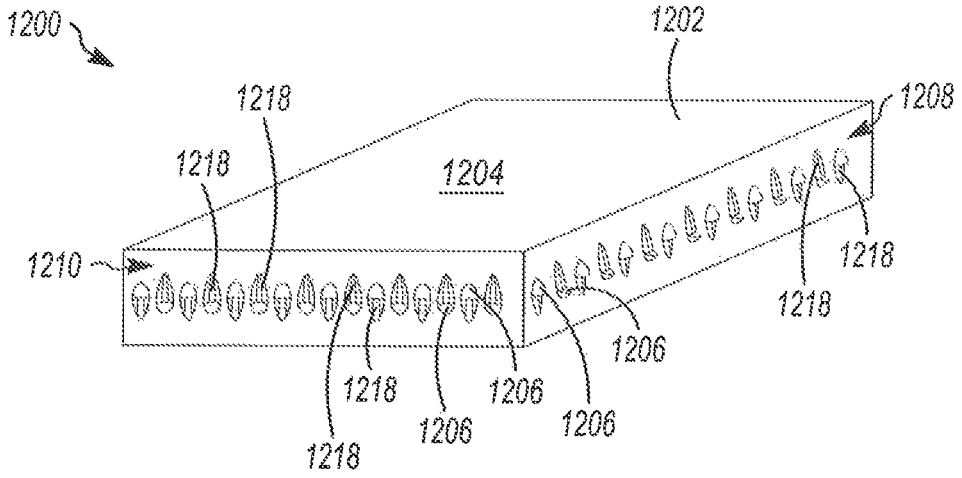
FIG. 12 is a perspective view of yet another example textured workpiece.

Referring now to FIG. 12, another workpiece 1200 is shown. In the example shown, the workpiece 1200 has a body 1202 that is planar. The body 1202 is also solid. In alternative examples, the workpiece can be non-planar, and/or can be hollow and seamless.

The body 1202 of the workpiece 1200 has an outer surface 1204, and the outer surface 1204 has surface portions that are non-parallel. Particularly, the outer surface 1204 includes at least a first surface portion 1208, and a second surface portion 1210, which are oriented perpendicular to each other. In other examples, other non-parallel angles are possible. A first set of barbs 1206 extends from and is integral with the first surface portion 1208, and a second set of barbs 1206 extends from and is integral with the second surface portion 1210. A first set of grooves 1118 is formed in the first surface portion 1208, and each barb 1206 of the first set of barbs 106 is associated with a respective one of the grooves 1218 of the first set of grooves. A second set of grooves 1218 is formed in the second surface portion 1210, and each barb 1206 of the second set of barbs 1206 is associated with a respective one of the grooves 1218 of the second set of grooves 1218.

Figure 13:
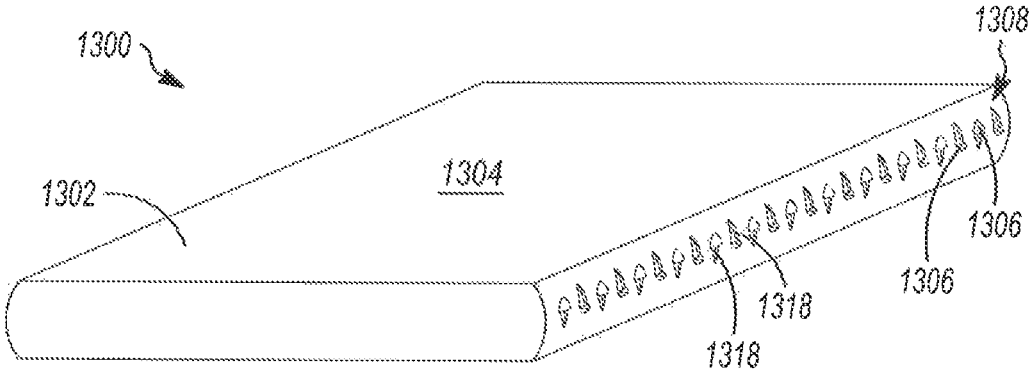
FIG. 13 is a perspective view of yet another example textured workpiece.

Referring now to FIG. 13, another workpiece 1300 is shown. In the example shown, the workpiece 1300 has a body 1302 that is planar. The workpiece is also solid. In alternative examples, the workpiece can be non-planar, and/or can be hollow and seamless.

The body 1302 of the workpiece 1300 has an outer surface 1304, and the outer surface 1304 includes at least a first portion that is non-planar and that is textured with integral barbs 1306 and grooves 1318. Particularly, in the example shown, the outer surface 1304 has first surface portion 1308 that is curved and that is textured with integral barbs 1306 and grooves 1318. More specifically, a first set of barbs 1306 extends from and is integral with the first surface portion 1308. A first set of grooves 1318 is formed in the first surface portion 1308, and each barb 1306 is associated with a respective one of the grooves 1318.

As mentioned above, the workpieces described above may in some examples be textured by gouging. Specifically, a method for texturing a workpiece will be described with reference to FIGS. 14 and 15. The method will be described with reference to the workpiece 100 of FIGS. 1 to 5; however, the method may be carried out to texture other workpieces (e.g. workpieces 1000, 1100, 1200, or 1300), and the workpiece 100 may be manufactured according to other methods.

Figure 14:
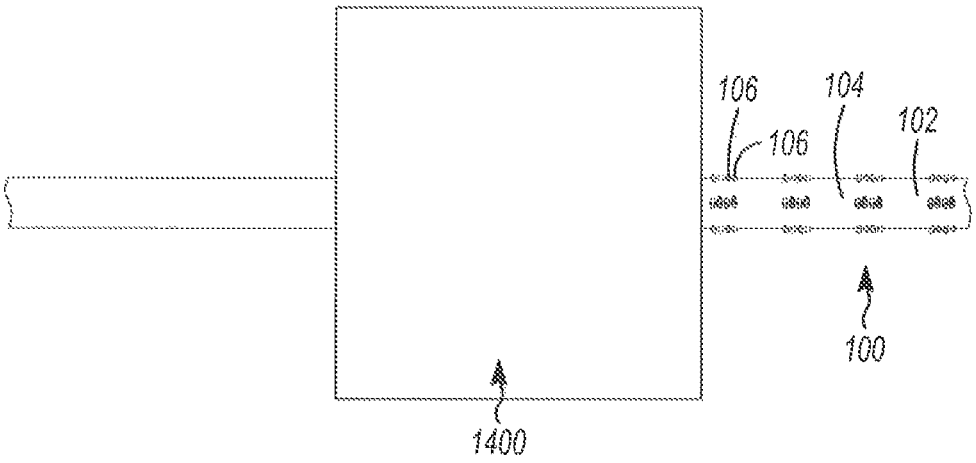
FIG. 14 is a schematic side view of the workpiece of FIG. 1 being textured in a texturing apparatus.

Referring to FIG. 14, in the example shown, the workpiece 100 is supplied to a texturing apparatus 1400. In the texturing apparatus 1400, the outer surface 104 is gouged to create the barbs 106. Gouging may be achieved by impacting the outer surface 104 with one or more teeth, described below.

Figure 15:
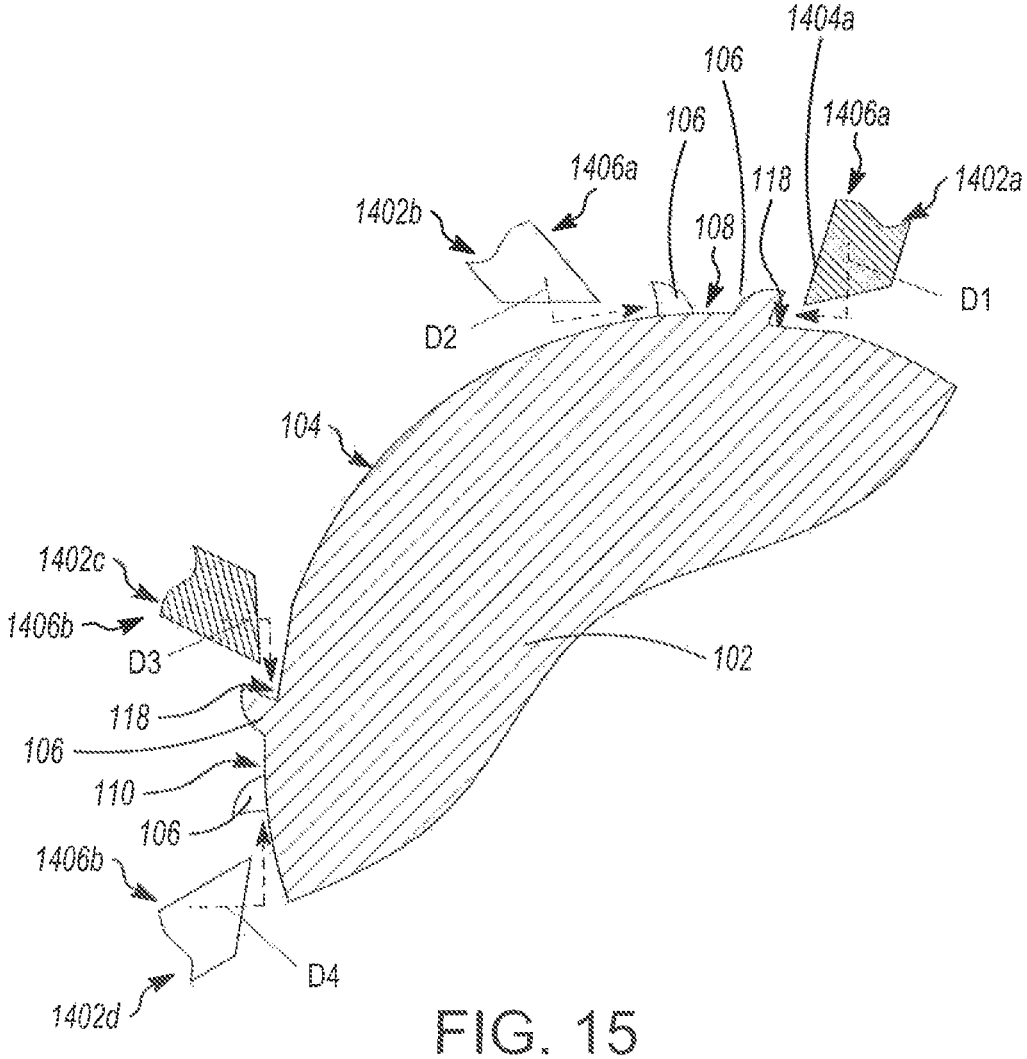
FIG. 15 is a partial cross-sectional view of the workpiece of FIG. 1 being textured in the texturing apparatus of FIG. 14.

Referring to FIG. 15, a first blade 1402*a* having one tooth 1404*a* is actuated to impact the outer surface 104, to create one barb 106 in the outer surface 104. In the example shown, the first blade 1402*a* and first tooth 1404*a* are moved towards the body 102 and across the body 102 (along a path indicated by arrow D1), to cut the outer surface 104 and create a groove 118 in the outer surface 104. The removed material forms a barb 106, which remains attached to the outer surface 104.

In examples wherein the workpiece is hollow (e.g. the workpiece 1000 or 1100), the tooth 1404*a* can cut the outer surface of the workpiece without perforating through the wall of the workpiece.

In alternative examples, a blade having a plurality of teeth may be actuated to impact the outer surface to create a plurality of barbs in the outer surface.

In some examples, the texturing apparatus can include several blades. Particularly, in the example shown, the texturing apparatus includes sixteen blades (only four of which are shown, i.e. first blade 1402*a*, second blade 1402*b*, third blade 1402*c*, and fourth blade 1402*d*), which when actuated create sixteen barbs 106 in the outer surface.

In the example shown, the blades are arranged in four sets of four. The first set 1406*a* of blades includes the first blade 1402*a* and an additional blade (hidden by the first blade in FIG. 15) identical to and spaced longitudinally from the first blade, as well as the second blade 1402*b* and an additional blade (hidden by the second blade in FIG. 15) identical to and spaced longitudinally from the second blade. The first set 1406*a* of blades gouges the first surface portion 108 to create four barbs 106. The second set 1406*b* of blades includes the third blade 1402*c* and an additional blade (hidden by the third blade in FIG. 15) identical to and spaced longitudinally from the third blade, as well as the fourth blade 1402*d* and an additional blade (hidden by the fourth blade in FIG. 15) identical to and spaced longitudinally from the fourth blade. The second set 1406*b* of blades gouges the second surface portion 110 to create four barbs 106. The third and fourth sets of blades are configured similarly to the first and second sets of blades.

In the example shown, the blades are actuated in pairs. That is, the first blade 1402*a* second blade 1402*b* are actuated simultaneously and in generally opposite directions, the third blade 1402*c* and fourth blade 1402*d* are actuated simultaneously, in generally opposite directions, and so on. Actuation of the blades in pairs can balance the forces acting on the body during gouging. This can create a pair of barbs pointing or leaning in opposite directions, as shown.

Furthermore, in the examples shown, the sets of blades are actuated simultaneously. That is, all sixteen blades are actuated at the same time. In alternative examples, the pairs of blades may be actuated at different times. For example, the first blade 1402*a* and second blade 1402*b* can be simultaneously actuated, following which the third blade 1402*c* and fourth blade 1402*d* can be simultaneously actuated, and so on.

In the example shown, the blades 1402*a-d* impact the outer surface 104 several times repeatedly, as the workpiece 100 is moved longitudinally through the texturing apparatus 1400, to create several barbs 106 along the length of the workpiece 100.

In some examples, blades or sets of blades may be simultaneously actuated, but in different directions and/or along different paths. In the example shown, the blades 1402*a*, 1402*b* of the first set 1406*a* are actuated generally downward towards the body and horizontally across the body (i.e. along a set of paths indicated by arrows D1 and D2), to gouge the first surface portion 108, and the blades 1402*c*, 1402*d* of the second set 1406*b* are actuated generally horizontally towards the body and vertically across the body (i.e. along a set of paths indicated by arrows D3 and D4, respectively), to gouge the second surface portion 110 (which is spaced circumferentially from the first surface portion 108). In this example the paths D1 and D2 are at a different orientation from the paths D3 and D4.

The movement and configuration of the blades 1402*a*-1402*d*, as well as the movement of the workpiece 100 through the texturing apparatus 1400, may be tuned to create barbs and grooves of a desired shape, size, and pattern in the workpiece 100. For example, in workpiece 100, each surface portion includes four barbs 106, and the sets of barbs 106 are spaced apart along the circumference of the body 102 by 90 degrees, and also spaced apart along the length of the body 102. In alternative examples, the barbs 106 may be in another pattern, for example a spiral pattern. In further alternative examples, the barbs 106 may be continuous along the length and circumference of the body 102.

The bodies described herein can be made of any material suitable for texturing by gouging (as described above). Such materials are generally ductile (e.g. at room temperature or when heated or cooled). Non-limiting examples of materials from which the body can be made include metals or alloys such as steel, tin, copper, gold, silver, platinum, iron, titanium, or aluminum, certain plastics (e.g. those having a Shore hardness of at least approximately D55), or combinations thereof.

While the above description provides examples of one or more processes or apparatuses, it will be appreciated that other processes or apparatuses may be within the scope of the accompanying claims.

To the extent any amendments, characterizations, or other assertions previously made (in this or in any related patent applications or patents, including any parent, sibling, or child) with respect to any art, prior or otherwise, could be construed as a disclaimer of any subject matter supported by the present disclosure of this application, Applicant hereby rescinds and retracts such disclaimer. Applicant also respectfully submits that any prior art previously considered in any related patent applications or patents, including any parent, sibling, or child, may need to be re-visited.

The invention claimed is:

1. A reinforced material comprising:

a) a matrix material; and b) a body embedded in the matrix material, the body having i) an outer surface with at least a first surface portion in contact with the matrix material, ii) at least a first set of barbs gouged from the outer surface and extending from the first surface portion and embedded in the matrix material, and iii) at least a first set of grooves formed in the first surface portion, wherein each barb of the first set of barbs is associated with a respective one of the grooves of the first set of grooves, wherein the outer surface further comprises: c) a second surface portion; d) a second set of barbs gouged from the outer surface and extending from the second surface portion, and e) a second set of grooves formed in the second surface portion, wherein each barb of the second set of barbs is associated with a respective one of the grooves of the second set of grooves, wherein the body comprises a circular cross section; and wherein the sets of barbs are spaced apart along a circumference of the body, and the sets of barbs are spaced apart along a length of the body and form a series of lines of barbs extending longitudinally along the surface of the body, such that each line of barbs extending longitudinally is comprised of barbs pointing or leaning in opposite directions.

2. The reinforced material of claim 1, wherein the matrix material is concrete.

3. The reinforced material of claim 1, wherein the body comprises a metal or an alloy.

4. The reinforced material of claim 1, wherein the body comprises steel.

5. The reinforced material of claim 1, wherein the body has a cross sectional profile that is curved.

6. The reinforced material of claim 5, wherein the body extends along a longitudinal axis, and the first surface portion is spaced from the second surface portion in a direction transverse to the longitudinal axis.

7. The reinforced material of claim 5, wherein the body extends along a longitudinal axis, the first surface portion is at a first position along the longitudinal axis, and the second surface portion is at a second position along the longitudinal axis.

8. The reinforced material of claim 1, wherein the body is an elongate steel bar.

9. The reinforced material of claim 8, wherein the sets of barbs are spaced apart along a circumference of the body by 90 degrees.

10. The reinforced material of claim 8, wherein the sets of barbs are spaced apart along a circumference of the body in a spiral pattern.

11. The reinforced material of claim 1, wherein the first surface portion has a first curvature, and the second surface portion has a second curvature, and the first curvature is different from the second curvature.

* * * * *